US011794319B2

(12) United States Patent
Chen

(10) Patent No.: US 11,794,319 B2
(45) Date of Patent: Oct. 24, 2023

(54) SCREWDRIVER

(71) Applicant: Ming-Chang Chen, Kaohsiung (TW)

(72) Inventor: Ming-Chang Chen, Kaohsiung (TW)

( * ) Notice: Subject to any disclaimer, the term of this patent is extended or adjusted under 35 U.S.C. 154(b) by 135 days.

(21) Appl. No.: 17/500,293

(22) Filed: Oct. 13, 2021

(65) Prior Publication Data

US 2023/0112779 A1 Apr. 13, 2023

(51) Int. Cl.
*B25B 23/12* (2006.01)
*B25B 23/00* (2006.01)

(52) U.S. Cl.
CPC ..... *B25B 23/12* (2013.01); *B25B 23/005* (2013.01); *B25B 23/0035* (2013.01)

(58) Field of Classification Search
CPC ... B25B 23/12; B25B 23/0035; B25B 23/005; B25B 15/02
See application file for complete search history.

(56) References Cited

U.S. PATENT DOCUMENTS 3,288,185 A * 11/1966 Clark ..... B25B 23/10 81/451
9,227,309 B2 * 1/2016 Moss ..... B25B 23/0035
9,406,423 B1 * 8/2016 Tsai ..... B25B 13/06
9,505,108 B2 * 11/2016 Peters ..... B25B 23/0035
10,792,793 B2 * 10/2020 Moss ..... B25B 23/12
11,123,847 B2 * 9/2021 Huang ..... B25B 13/06
11,396,090 B2 * 7/2022 Lai ..... B25B 23/0035
2016/0279769 A1 * 9/2016 Arslan ..... B25B 23/12
2017/0120428 A1 * 5/2017 Wang ..... B25B 23/12
2017/0326713 A1 * 11/2017 Tsai ..... B25B 15/02

FOREIGN PATENT DOCUMENTS

CN 205043687 U 2/2016

* cited by examiner

*Primary Examiner* — David B. Thomas

(57) ABSTRACT

A screwdriver includes a first section, a second section where a positioning groove is annularly formed, a sleeve member detachably disposed on the second section, and an engagement member disposed in the sleeve member. The sleeve member has a body with a through hole, a magnetic unit disposed in the through hole, and an accommodation groove adapted to accommodate the engagement member. When the second section and the sleeve member engage in position, the accommodation groove and the positioning groove meet to engage the engagement member with the positioning groove. The engagement between the second section and the sleeve member allows a gap to be formed between a screw head and the sleeve member while inserting the second section into a socket of the screw head, so the magnetic attraction exists without the contact between the sleeve member and the screw head for a firm engagement therebetween.

5 Claims, 9 Drawing Sheets

SCREWDRIVER

BACKGROUND OF THE INVENTION

1. Field of the Invention

This invention relates to a driving tool and relates particularly to a screwdriver.

2. Description of the Related Art

Referring to FIG. 1 and FIG. 2, a magnetic screwdriver 1 is disclosed in a China Patent No. CN205043687U, the conventional magnetic screwdriver 1 comprises a tool unit 11, an extending unit 12 formed on the tool unit 11, a sleeve unit 13 sleevedly disposed on the tool unit 11, a magnetic unit 14 disposed on an end of the sleeve unit 13, and an engagement unit 15 disposed on another end of the sleeve unit 13. The tool unit 11 has a first section 111, a second section 112 opposite to the first section 111, and a third section 113 connected between the first section 111 and the second section 112. The extending unit 12 is integrated with the tool unit 11 and located between the second section 112 and the third section 113. The sleeve unit 13 has a body 130, a through hole 131 located in the middle of the body 130 and penetrating through the body 130, a bottom groove 132 formed on an end of the body 130, and a top groove 133 formed on another end of the body 130. A diameter 131A of the through hole 131 is larger than a maximum diameter 12A of the extending unit 12. The magnetic unit 14 is disposed in the bottom groove 132 of the sleeve unit 13. The engagement unit 15 is disposed in the top groove 133 of the sleeve unit 13. When the sleeve unit 13 sleeves on the tool unit 11, the sleeve unit 13 is restricted by the engagement unit 15 and the extending unit 12 to move within the third section 113. The extending unit 12 helps prevent the sleeve unit 13 from moving to the second section 112. When the second section 112 of the tool unit 11 is inserted into a socket 21 of a screw head 2, a distance B1 defined between the magnetic unit 14 and the screw head 2 is smaller than a distance B2 defined between the magnetic unit 14 and the extending unit 12. The magnetic unit 14 then attracts the screw head 2 through the magnetic force to cause the sleeve unit 13 to move toward the second section 112 along the third section 113 but being restricted by the extending unit 12 whereby the magnetic unit 14 contacts the screw head 2 and drives the screw head 2 to execute a screwing operation. When the screw head 2 is removed from the second section 112 of the tool unit 11, the sleeve unit 13 then moves toward the first section 111 along the third section 113.

However, the conventional magnetic screwdriver 1 still has deficiencies as follows:

1. The magnetic unit 14 is in contact with the screw head 2 directly when the second section 112 is positioned in the socket 21 of the screw head 2. Thus, metal chips or powders of the screw head 2 caused during the screwing operation will adhere to the magnetic unit 14 easily, and that will reduce the magnetic force of the magnetic unit 14. Although most of the metal chips or powders can be cleaned by other tools, it is difficult to remove all metal chips or powders. Accordingly, the magnetic attraction between the magnetic unit 14 and the screw head 2 is affected and the magnetic unit 14 cannot guide the screw head 2 effectively. The screwing operation then cannot be executed smoothly.

2. The sleeve unit 13 cannot be detached from the tool unit 11. The sleeve unit 13 can only slide within the third section 113 but cannot be separated from the tool portion 11. When the magnetic unit 14 attracts and releases the screw head 2 to allow the sleeve unit 13 to slide along the third section 113, the metal chips or powders will enter and accumulate between the through hole 131 and the third section 113, and that causes the metal chips or powders to be cleaned away difficultly since the sleeve unit 13 cannot be separated from the tool unit 11. Further, accumulated metal chips or powders will hinder the sleeve unit 13 from sliding. Accordingly, the magnetic unit 14 cannot attract and guide the screw head 2 and the screwing operation is affected.

3. Only if a type of the second section 112 is corresponding to a type of the socket 21 of the screw head 2 can the second section 112 be introduced into the socket 2 to further drive the screw head 2. However, the sleeve unit 13 cannot be removed from the tool unit 11. Several magnetic screwdrivers 1 should be prepared in order to execute a screwing operation of screw heads 2 with different sockets 21, and that will burden the user to bring many heavy magnetic screwdrivers 1. If once the second section 112 of the tool unit 11 is damaged after a long-term use or the magnetic force of the magnetic unit 14 is reduced, the magnetic screwdriver 1 can only be abandoned. Thus, the cost is increased, and that requires to be improved.

SUMMARY OF THE INVENTION

The object of this invention is to provide a screwdriver capable of supporting a screw head stably and facilitating a screwing operation of the screw head to be smooth, speedy, and steady.

The screwdriver comprises a first section, a second section connected to the first section, a sleeve member detachably disposed on an outer periphery of the second section, and an engagement member disposed in the sleeve member. A positioning groove is annularly formed on the outer periphery of the second section. The sleeve member has a body defining a top end and a bottom end, a through hole formed through the body for defining an inner peripheral wall between the top end and the bottom end, a magnetic unit disposed in the through hole and located opposite to the top end, and an accommodation groove recessed into the inner peripheral wall and formed opposite to the bottom end. The engagement member is disposed in the accommodation groove. When the sleeve member is properly positioned on the second section by passing the second section through the through hole, the accommodation groove and the positioning groove meet each other so as to engage the engagement member with the positioning groove and achieve a firm engagement between the sleeve member and the second section. A gap is formed between a top surface of a screw head and the bottom end of the sleeve member when the second section is positioned properly in a socket of the screwhead. Thus, the magnetic unit can attract the screw head though the magnetic force without contacting the screw head to thereby position and guide the screw head stably, help stabilize the screw head, and accelerate a screwing operation of the screw head. Meanwhile, the sleeve member can be separated from the second section and engaged with another second section provided with different types to thereby increase the convenience of use and practicality. Further, metal chips or powders generated during the screwing operation can be cleaned easily and quickly by removing the sleeve member from the second section and cleaning the metal chips or powders thereafter whereby the magnetic effect of the sleeve member is improved and the service life of the sleeve member is prolonged.

Preferably, a cover unit extends outwards from the bottom end of the sleeve member. The cover unit defines a room communicating with the through hole.

Preferably, the cover unit includes a lower end and an upper end. The upper end is connected to the bottom end of the sleeve member. An inner diameter of the lower end is larger than an inner diameter of the upper end.

Preferably, the room of the cover unit defines a maximum diameter larger than a diameter of the through hole of the sleeve member.

Preferably, the gap ranges from 2 mm to 3 mm.

Preferably, the second section is formed into a cruciform type, a square type, or a hexalobular type.

Preferably, the sleeve member is positioned in the middle of the second section when the accommodation groove and the positioning groove meet each other.

DETAILED DESCRIPTION OF THE PREFERRED EMBODIMENTS

Figure 1:
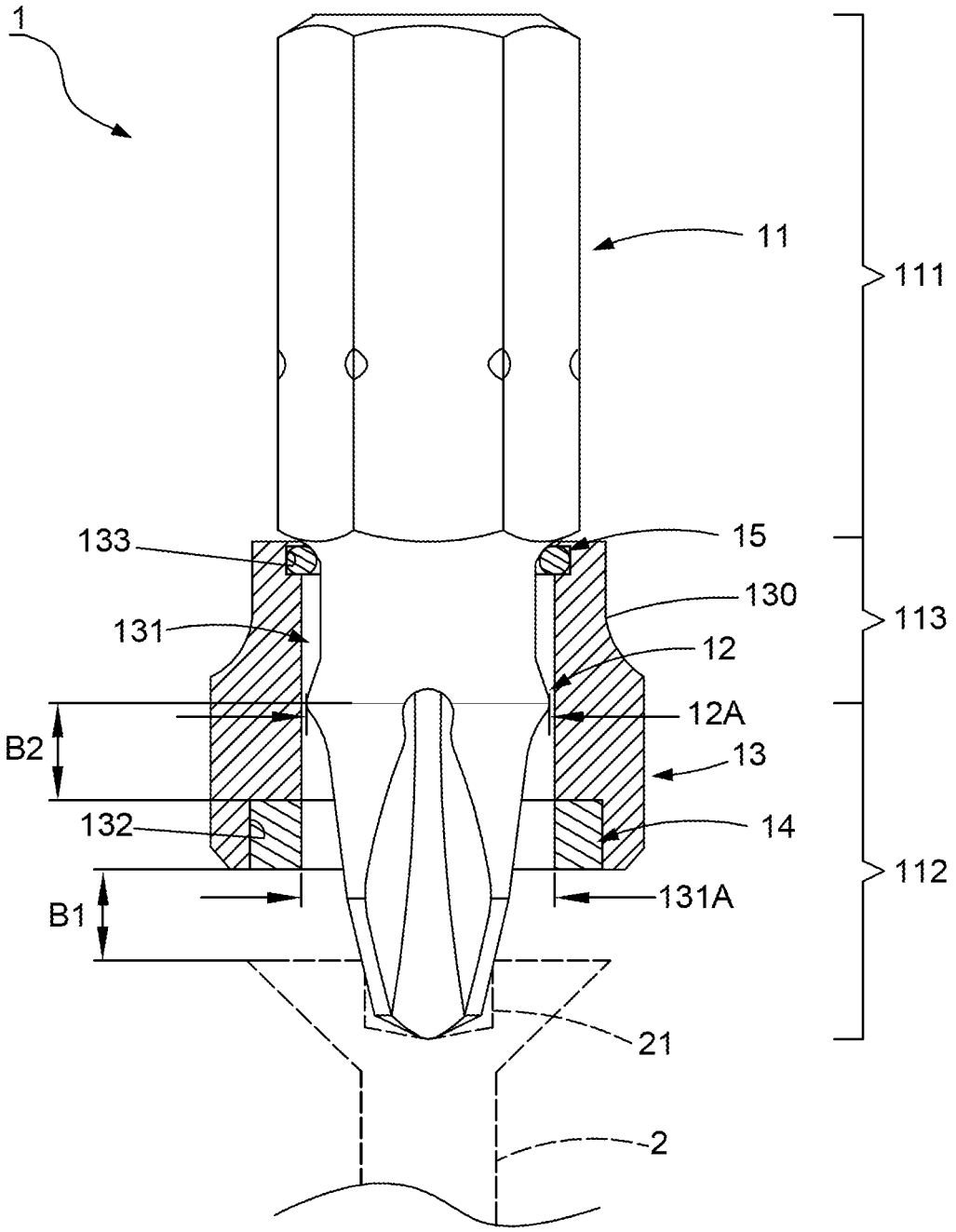
FIG. 1 (PRIOR ART)
FIG. 1 is a schematic view showing a conventional magnetic screwdriver.
Figure 2:
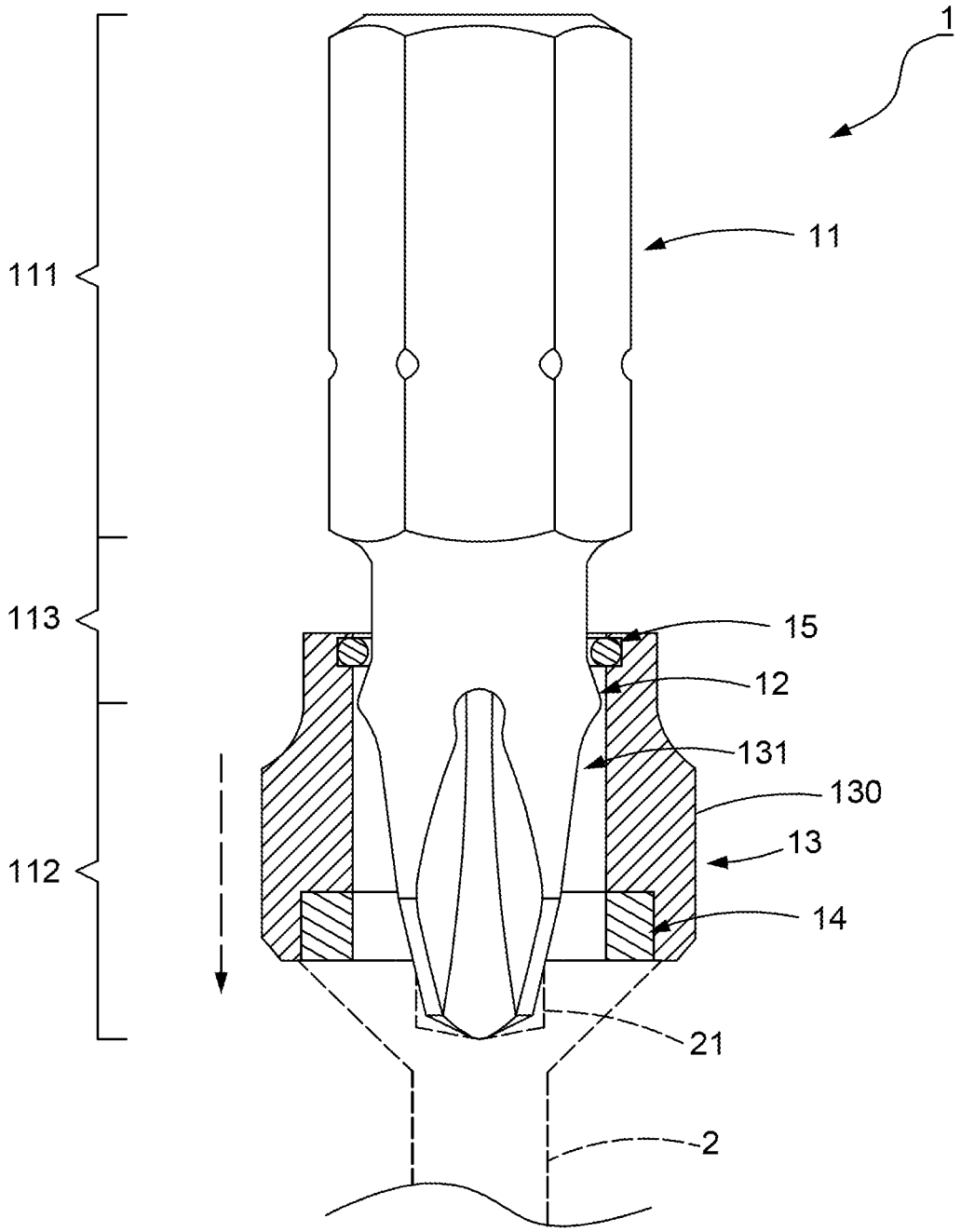
FIG. 2 (PRIOR ART)
FIG. 2 is a schematic view showing an operation of the conventional magnetic screwdriver.
Figure 3:
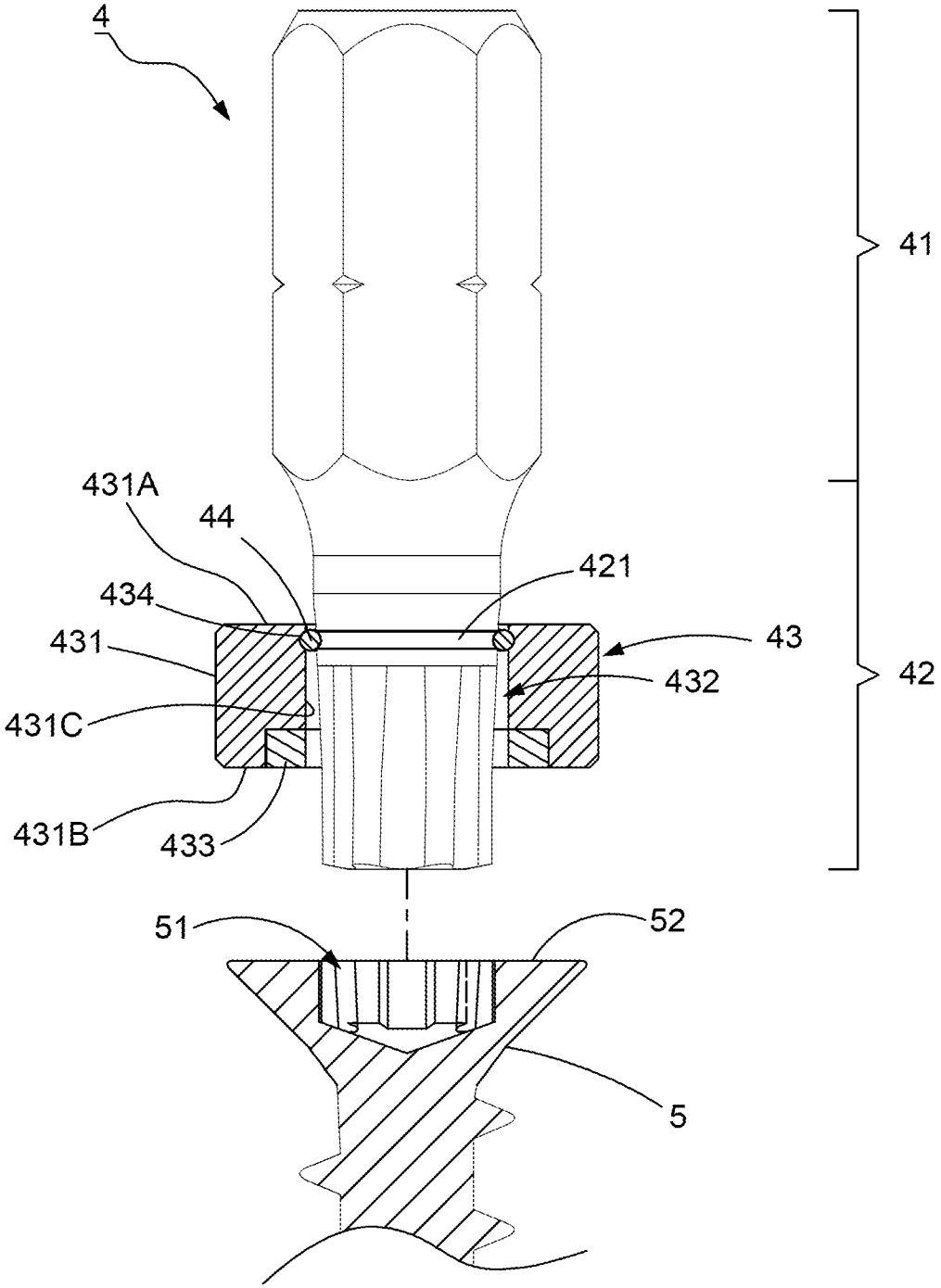
FIG. 3 is a schematic view showing a first preferred embodiment of this invention.

Referring to FIG. 3, a first preferred embodiment of a screwdriver 4 is disclosed. The screwdriver 4 is driven by a driving tool (not shown) and adapted to engage with a socket 51 of a screw head 5 in order to drive the screw head 5 to execute a screwing operation. The screwdriver 4 in this preferred embodiment comprises a first section 41 adapted to engage with the driving tool, a second section 42 connected to the first section 41 and adapted to engage with the socket 51 of the screw head 5, a sleeve member 43 sleevedly disposed on an outer periphery of the second section 42 and capable of being separated from the second section 42, and an engagement member 44 disposed in the sleeve member 43 and adapted to fix the sleeve member 43 to the second section 42. A positioning groove 421 is annularly recessed into the outer periphery of the second section 42. A type of the second section 42 is corresponding to a type of the socket 51 of the screw head 5. The type of the second section 42 is formed into a cruciform type, a square type, a hexalobular type or other polygonal types. Here takes an example that the second section 42 is a hexalobular type which is commonly known as a Torx type.

Figure 4:
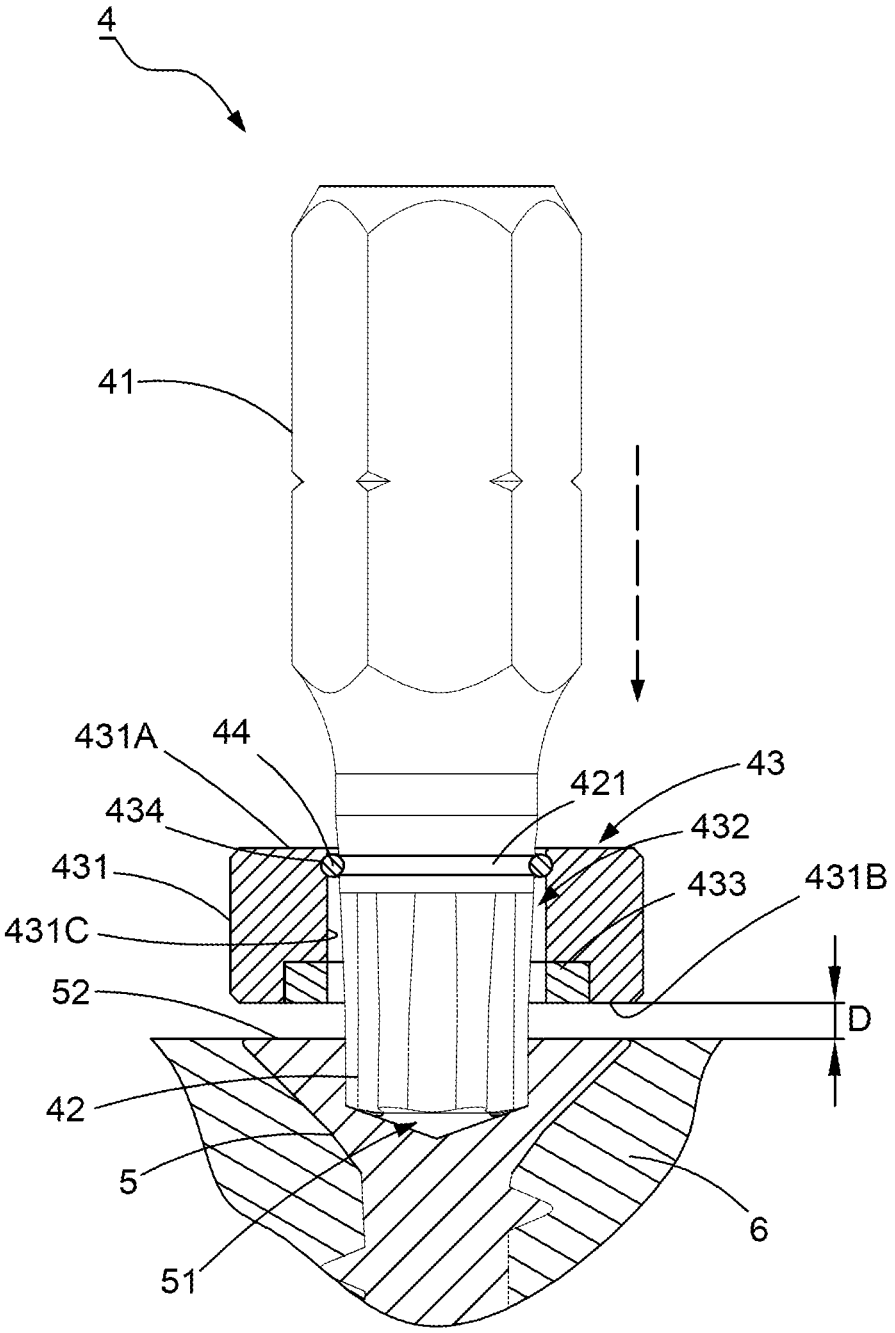
FIG. 4 is a schematic view showing an operation of the first preferred embodiment of this invention.

Referring to FIG. 3 and FIG. 4, the sleeve member 43 has a body 431 defining a top end 431A and a bottom end 431B, a through hole 432 penetrating through the body 431 for defining an inner peripheral wall 431C between the top end 431A and the bottom end 431B, a magnetic unit 433 disposed in the through hole 432 and located opposite to the top end 431A, and an accommodation groove 434 recessed into the inner peripheral wall 431C and formed opposite to the bottom end 431B. The engagement member 44 is disposed in the accommodation groove 434.

When the second section 42 passes through the through hole 432 of the sleeve member 43 to position the sleeve member 43 properly on the second section 42, the accommodation groove 434 and the positioning groove 421 are located in correspondence and aligned with each other to thereby restrict the engagement member 44 between the accommodation groove 434 and the positioning groove 421 and position the sleeve member 43 in the middle of the second section 42. Thus, a firm engagement between the sleeve member 43 and the second section 42 is achieved. When the second section 42 is engaged with the socket 51 of the screw head 5, the bottom end 431B of the body 431 is adjacent to but not in contact with a top surface 52 of the screw head 5 to thereby form a gap D between the top surface 51 and the bottom end 431B. The gap D ranges from 2 mm to 3 mm.

Figure 5:
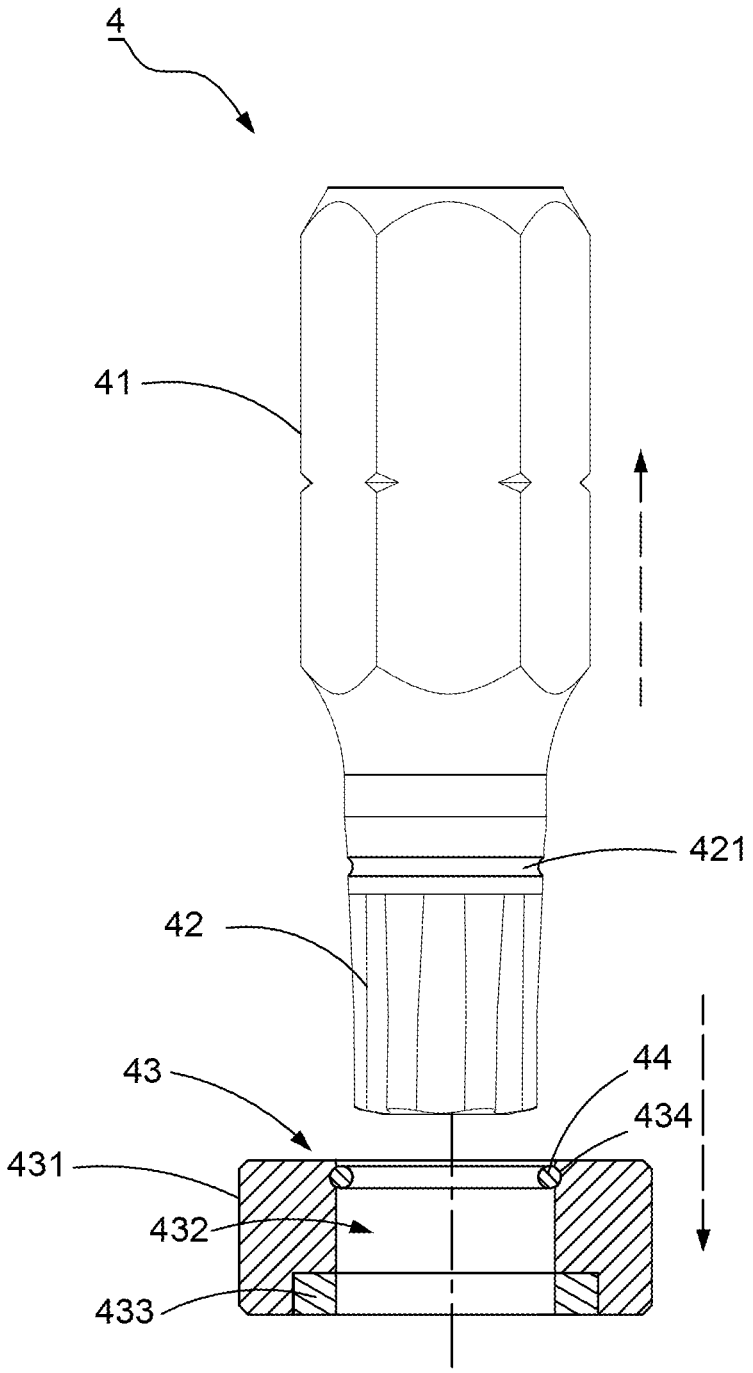
FIG. 5 is a schematic view showing that the sleeve member is detached from the second section.

Referring to FIG. 4 and FIG. 5, an installation of the screwdriver 4 is executed by inserting the second section 42 through the through hole 432 of the sleeve member 43 until the accommodation groove 434 and the positioning groove 421 face each other to thereby engage the engagement member 44 with the positioning groove 421. Thus, the sleeve member 43 is positioned in the middle of the second section 42. After that, the second section 42 is inserted into the socket 51 of the screw head 5 to form the gap D between the bottom end 431B of the sleeve member 43 and the top surface 52 of the screw head 5, so the magnetic unit 433 attracts the screw head 5 though the magnetic force without being in contact with the screw head 5 whereby the screw head 5 is positioned stably and properly. Further, the magnetic attraction between the magnetic unit 433 and the screw head 5 can help guide and straighten the screw head 5. After the screw head 5 is straightened by the screwdriver 4, a rotational force is applied on the screwdriver 4 to further rotate the screw head 5 into an object 6 quickly and stably until the screw head 5 enters into the object 6 entirely to achieve a tight engagement between the screw head 5 and the object 6. Finally, the second section 42 of the screwdriver 4 is removed from the socket 51 of the screw head 5 whereby the screwing operation of the screw head 5 is completed.

After the sleeve member 43 is properly engaged with the second section 42, the sleeve member 43 is positioned in the middle of the second section 42 stably. Hence, the bottom end 431B of the sleeve member 43 is spaced apart from the top surface 52 of the screw head 5 to form the gap D after the second section 42 is inserted into the socket 51 of the screw head 5. Thus, the gap D helps prevent metal chips or powders caused during the screwing operation from adhering to the magnetic unit 433 while the magnetic attraction is still maintained. Meanwhile, the gap D also prevents the top surface 52 of the screw head 5 from being rubbed unduly by the sleeve member 43. If the metal chips or powders enter into the through hole 432, the metal chips or powders can be cleaned easily by detaching the sleeve member 43 from the second section 42 as shown in FIG. 5. After the metal chips or powders in the through hole 432 are removed, the second section 42 is inserted into the sleeve member 43 through the through hole 432 until the engagement member 44 is engaged with the positioning groove 421 whereby the sleeve member 43 is properly engaged with the second section 42 and the screwdriver 4 can be used again.

Figure 6:
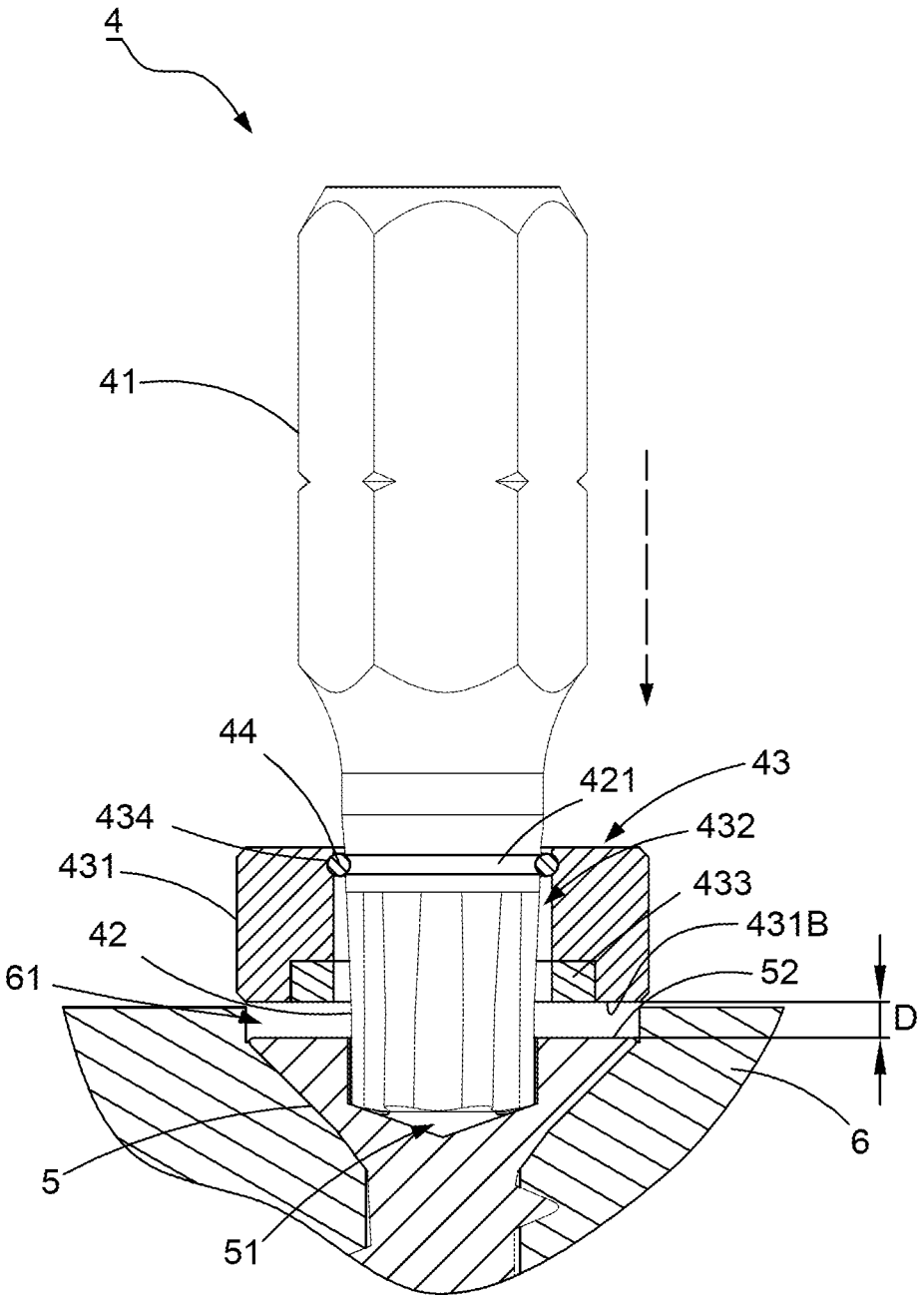
FIG. 6 is a schematic view showing that the screwdriver is adapted to rotate the screw head into an object provided with a pre-drilled opening.

Referring to FIG. 6 shows the object 6 is provided with a pre-drilled opening 61. After the second section 42 is positioned in the socket 51 of the screw head 5, the screwdriver 4 can drive the screw head 5 to screw into the opening 61 of the object 6 without being hindered by the sleeve member 43. Because the sleeve member 43 is not in contact with the top surface 52 of the screw head 5 to form the gap D when the second section 42 is inserted into the socket 51 of the screw head 5, the sleeve member 43 will not contact and press the object 6 to further allow the second section 42 to screw the screw head 5 deeply into the opening 61. Meanwhile, the screwing operation of the screw head 5 can be completed in one time and no additional tool is required. Further, the opening 61 will not be damaged by the screwdriver 4. The screwing operation of the screw head 5 can be executed smoothly to thereby attain the speedy and steady screwing effect. In order to drive the screw head 5 provided with different types of sockets 51, the sleeve member 43 can be separated from the second section 42 and detachably disposed on another second section 42 having the type in correspondence with the socket 51 of the screw head 5. Hence, the user's burden is lightened by bringing only one sleeve member 43 and different second sections 42. Further, when the sleeve member 43 is worn or damaged, the second section 42 can be still kept to be used with other sleeve member 43. Alternatively, when the second section 42 is worn or damaged, the sleeve member 43 can be kept to be used with other second section 42 to thereby reduce the cost and increase the convenience of use.

Figure 7:
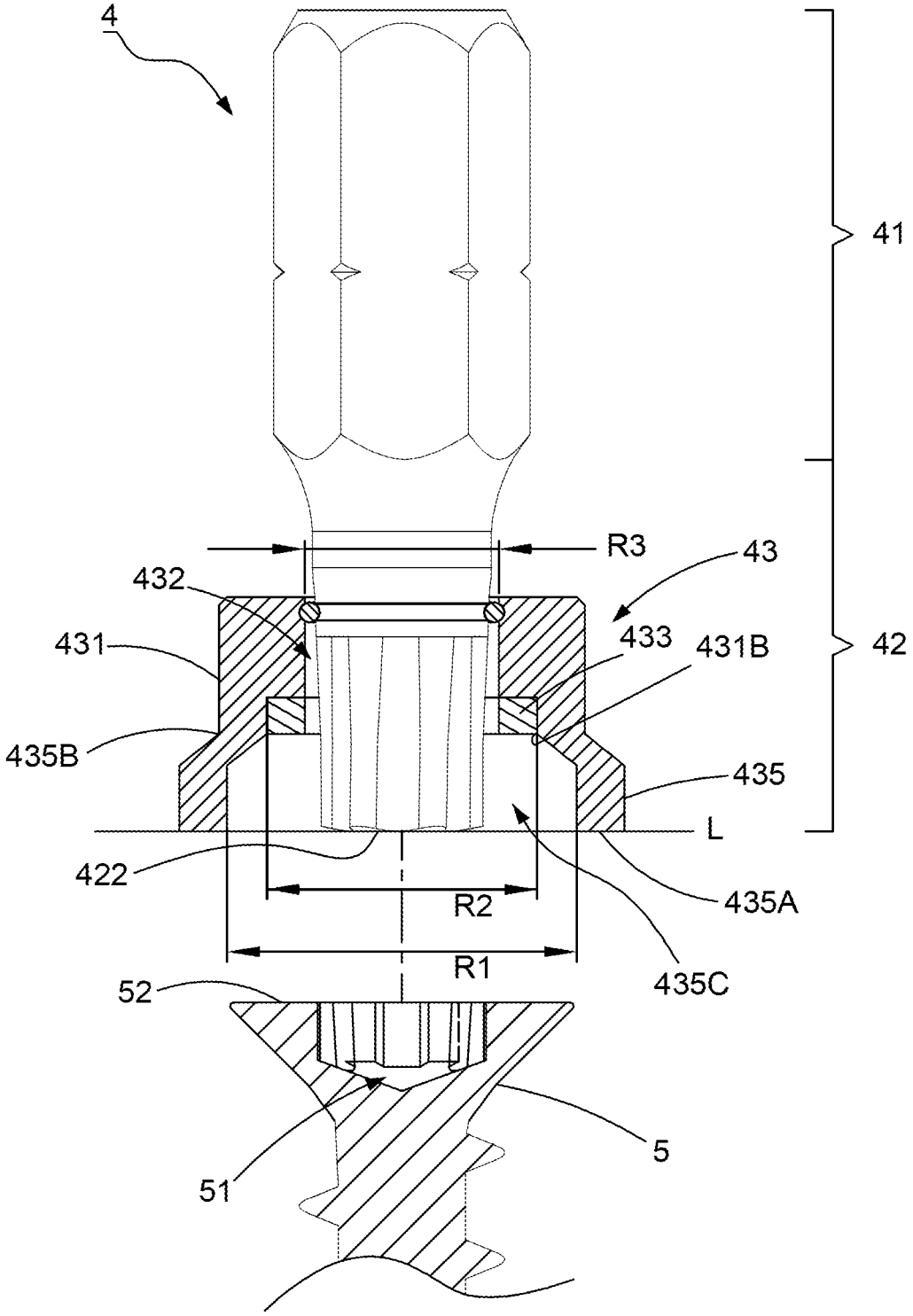
FIG. 7 is a schematic view showing a second preferred embodiment of this invention characterized by the cover unit.
Figure 8:
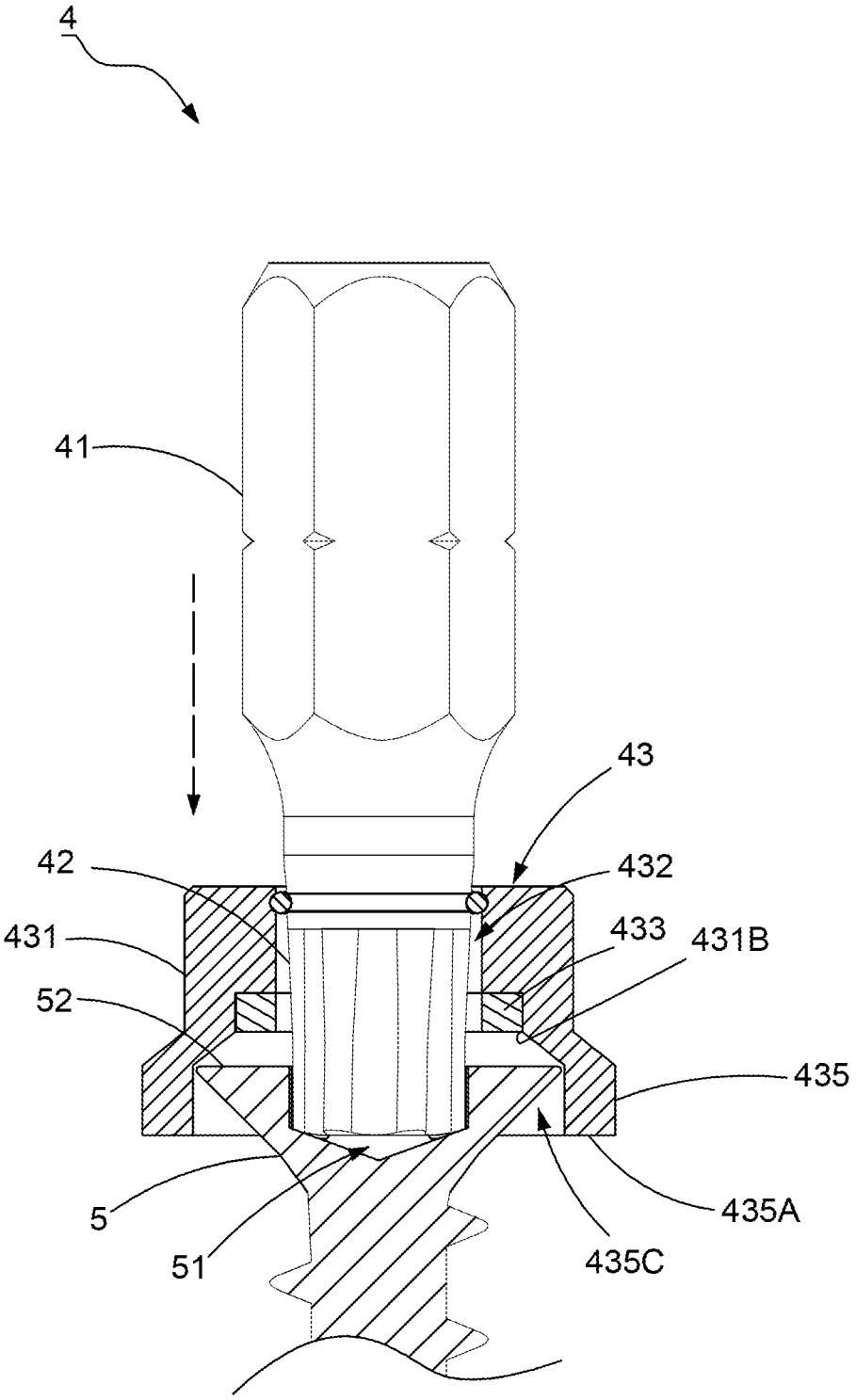
FIG. 8 is a schematic view showing an operation of the second preferred embodiment of this invention.
Figure 9:
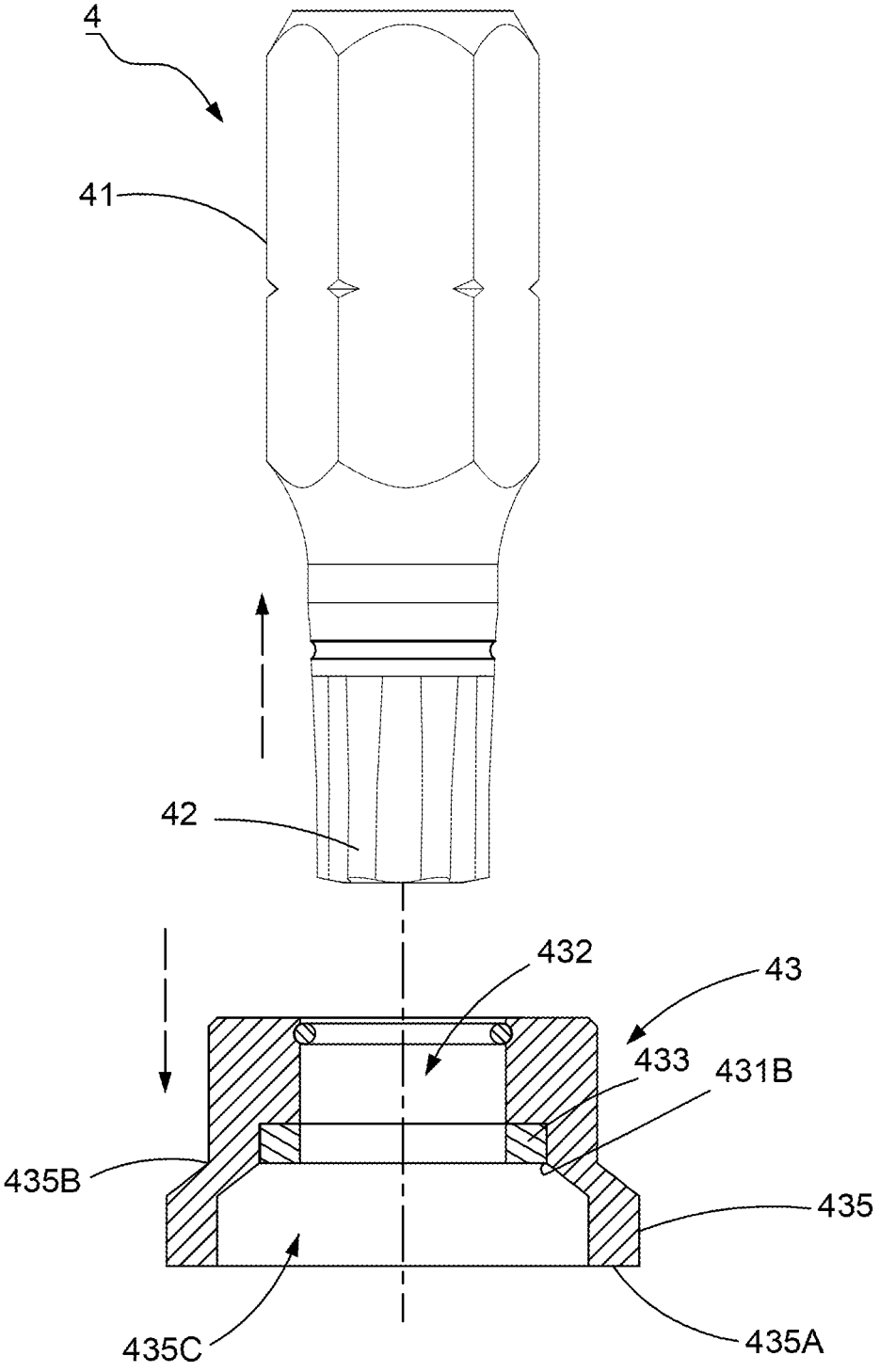
FIG. 9 is a schematic view showing that the sleeve member is detached from the second section.

Referring to FIG. 7 and FIG. 8 show a second preferred embodiment of the screwdriver 4 of this invention. The correlated elements and the concatenation of elements, the operation and objectives of the second preferred embodiment are the same as those of the first preferred embodiment. This embodiment is characterized in that a cover unit 435 extends outwards from the bottom end 431B of the sleeve member 43 and defines a room 435C communicating with the through hole 432. The cover unit 435 has a lower end 435A and an upper end 435B. The upper end 435B is connected to the bottom end 431B of the sleeve member 43. An inner diameter R1 of the lower end 435A is larger than an inner diameter R2 of the upper end 435B. The inner diameter R1 of the lower end 435A is also larger than a diameter R3 of the through hole 432 of the sleeve member 43. In this preferred embodiment, the inner diameter R1, as for instance shown in FIG. 7, can be deemed to be a maximum diameter of the room 435C of the cover unit 435. The lower end 435A of the cover unit 435 and an end surface 422 of the second section 42 are aligned horizontally when the sleeve member 43 is positioned properly on the second section 42. In other words, the lower end 435A of the cover unit 435 and the end surface 422 of the second section 42 are located at the same horizontal line L when the sleeve member 43 is properly engaged with the second section 42. Thus, when the second section 42 is placed in the socket 51 of the screw head 5, the lower end 435A will not contact the top surface 52 of the screw head 5 but surround the screw head 5 to thereby retain the metal chips or powders within the room 435C of the cover unit 435 and prevent the metal chips or powders from spurting or hurting the user during the screwing operation. Simultaneously, the magnetic unit 433 can still attract the screw head 5 without contacting the screw head 5. After the screwing operation of the screw head 5 is completed, the metal chips or powders remained in the through hole 432 and the room 435C of the cover unit 435 can be cleaned easily by removing the sleeve member 43 from the second section 42 and cleaning the through hole 432 and the room 435C thereafter as shown in FIG. 9 to thereby improve the magnetic effect of the sleeve member 43 and improve the smoothness and the screwing effect of the screwing operation effectively.

To sum up, the screwdriver of this invention takes advantages that the engagement member is engaged with the positioning groove of the second section to position the sleeve member on the second section properly. When the second section is inserted into the socket of the screw, the bottom end of the sleeve member is spaced apart from the top surface of the screw head to form the gap whereby the magnetic unit can attract the screw head without being in contact with the screw head. Thus, the sleeve member can position and guide the screw head through the magnetic attraction to thereby accelerate the screwing operation of the screw head and attain the stable screwing effect. Further, the metal chips or powders caused during the screwing operation can be cleaned easily by detaching the sleeve member from the second section and cleaning the through hole thereafter to thereby improve the magnetic effect of the sleeve member and extend the service life of the sleeve member.

While the embodiments of this invention are shown and described, it is understood that further variations and modifications may be made without departing from the scope of this invention.

What is claimed is:

1. A screwdriver comprising a first section driven by a driving tool and a second section connected to said first section and adapted to engage with a socket of a screw head;

wherein a positioning groove is annularly formed on an outer periphery of said second section, a sleeve member being detachably disposed on said outer periphery of said second section, said sleeve member including a body defining a top end and a bottom end, a through hole formed through said body for defining an inner peripheral wall between said top end and said bottom end, a magnetic unit disposed in said through hole and located opposite to said top end, and an accommodation groove recessed into said inner peripheral wall and formed opposite to said bottom end, with an engagement member disposed within said accommodation groove and with said second section adapted to pass through said through hole of said sleeve member, said accommodation groove being located in correspondence with said positioning groove for alignment therewith when said sleeve member is properly positioned on said second section to thereby engage said engagement member with said positioning groove and confirm achievement of a firm engagement between said sleeve member and said second section, a cover unit extending outwards from said bottom end of said sleeve member and defining a room communicating with said through hole, a gap being formed between a top surface of said screw head and said bottom end of said sleeve member when said second section is properly engaged with said socket of said screw head.

2. The screwdriver according to claim 1, wherein said cover unit includes a lower end and an upper end, said upper end being connected to said bottom end of said sleeve member, an inner diameter of said lower end being larger than an inner diameter of said upper end.

3. The screwdriver according to claim 1, wherein said room of said cover unit defines a maximum diameter larger than a diameter of said through hole of said sleeve member.

4. The screwdriver according to claim 1, wherein said gap ranges from 2 mm to 3 mm.

5. The screwdriver according to claim 1, wherein said second section is formed into a cruciform type, a square type, or a hexalobular type.

* * * * *